US007015878B1

(12) United States Patent
Doyen et al.

(10) Patent No.: US 7,015,878 B1
(45) Date of Patent: Mar. 21, 2006

(54) METHOD FOR ADDRESSING A PLASMA DISPLAY PANEL

(75) Inventors: Didier Doyen, La Bouexière (FR); Carlos Correa, Schwenningen (DE)

(73) Assignee: Thomson Licensing, Boulogne-Billancourt (FR)

( * ) Notice: Subject to any disclaimer, the term of this patent is extended or adjusted under 35 U.S.C. 154(b) by 441 days.

(21) Appl. No.: 10/149,334

(22) PCT Filed: Nov. 23, 2000

(86) PCT No.: PCT/FR00/03258

§ 371 (c)(1),
(2), (4) Date: Oct. 4, 2002

(87) PCT Pub. No.: WO01/43112

PCT Pub. Date: Jun. 14, 2001

(30) Foreign Application Priority Data

Dec. 6, 1999 (FR) ..... 99 15331

(51) Int. Cl.
*G09G 3/28* (2006.01)

(52) U.S. Cl. ..... 345/60; 315/169.3

(58) Field of Classification Search ..... 345/60, 345/63, 67, 68, 72, 77, 79, 84, 89, 94, 99, 345/204, 208, 690–693; 315/169.1–169.4; 348/797

See application file for complete search history.

(56) References Cited

U.S. PATENT DOCUMENTS

| | | | | |
|---|---|---|---|---|
| 5,986,640 | A * | 11/1999 | Baldwin et al. | 345/89 |
| 6,127,991 | A * | 10/2000 | Uehara et al. | 345/60 |
| 6,424,325 | B1 * | 7/2002 | Van Dijk | 345/60 |
| 6,552,701 | B1 * | 4/2003 | Tanaka | 345/60 |
| 6,765,548 | B1 * | 7/2004 | Doyen et al. | 345/60 |
| 6,784,898 | B1 * | 8/2004 | Lee et al. | 345/692 |

FOREIGN PATENT DOCUMENTS

| | | | |
|---|---|---|---|
| EP | 874 349 | A1 | 10/1998 |
| EP | 945 846 | A1 | 9/1999 |
| EP | 945846 | A1 * | 9/1999 |
| WO | 94/09473 | | 4/1994 |

OTHER PUBLICATIONS

Search Report.

* cited by examiner

*Primary Examiner*—Amare Mengistu
(74) *Attorney, Agent, or Firm*—Joseph S. Tripoli; Harvey D. Fried; Sammy S. Henig

(57) ABSTRACT

The invention provides a combination of the technique of subscans common to two rows of display cells and division into two groups of subscans. Such a combination makes it possible to combine the beneficial effects of the two apparently incompatible techniques. The invention provides static and/or dynamic compensation of the subscans FSS specific to each cell by means of the subscans SSS common to two cells.

6 Claims, 6 Drawing Sheets

--PRIOR ART--

--PRIOR ART--

--PRIOR ART--

--PRIOR ART--

METHOD FOR ADDRESSING A PLASMA DISPLAY PANEL

This application claims the benefit under 35 U.S.C. § 365 of International Application PCT/FR00/03258, filed Nov. 23, 2000, which claims the benefit of French Application No. 9915331, filed Dec. 6, 1999.

The invention relates to a method of addressing a plasma display panel. More particularly, the invention relates to the coding of the gray levels of a panel of the type with separate addressing and sustaining.

Plasma display panels, called hereafter PDPs, are flat-type display screens. There are two large families of PDPs, namely PDPs whose operation is of the DC type and those whose operation is of the AC type. In general, PDPs comprise two insulating tiles (or substrates), each carrying one or more arrays of electrodes and defining between them a space filled with gas. The tiles are joined together so as to define intersections between the electrodes of the said arrays. Each electrode intersection defines an elementary cell to which a gas space corresponds, which gas space is partially bounded by barriers and in which an electrical discharge occurs when the cell is activated. The electrical discharge causes an emission of UV rays in the elementary cell and phosphors deposited on the walls of the cell convert the UV rays into visible light.

In the case of AC-type PDPs, there are two types of cell architecture, one called a matrix architecture and the other called a coplanar architecture. Although these structures are different, the operation of an elementary cell is substantially the same. Each cell may be in the ignited or "on" state or in the extinguished or "off" state. A cell may be maintained in one of these states by sending a succession of pulses, called sustain pulses, throughout the duration over which it is desired to maintain this state. A cell is turned on, or addressed, by sending a larger pulse, usually called an address pulse. A cell is turned off, or erased, by nullifying the charges within the cell using a damped discharge. To obtain various gray levels, use is made of the eye's integration phenomenon by modulating the durations of the on and off states using subscans, or subframes, over the duration of display of an image.

In order to be able to achieve temporal ignition modulation of each elementary cell, two so-called "addressing modes" are mainly used. A first addressing mode, called "addressing while displaying", consists in addressing each row of cells while sustaining the other rows of cells, the addressing taking place row by row in a shifted manner. A second addressing mode, called "addressing and display separation", consists in addressing, sustaining and erasing all of the cells of the panel during three separate periods. For more details concerning these two addressing modes, a person skilled in the art may, for example, refer to U.S. Pat. Nos. 5,420,602 and 5,446,344.

FIG. 1 shows the basic time division of the "addressing and display separation" mode for displaying an image. The total display time Ttot of the image is 16.6 or 20 ms, depending on the country. During the display time, eight subscans SB1 to SB8 are effected so as to allow 256 gray levels per cell, each subscan making it possible for an elementary cell to be "on" or "off" for an illumination time Tec which is a multiple of a value To. Hereafter, reference will be made to an illumination weight p, where p corresponds to an integer such that Tec=p.To. The total duration of a subscan comprises an erasure time Tef, an address time Ta and the illumination time Tec specific to each subscan. The address time Ta can also be decomposed into n times an elementary time Tae, which corresponds to the addressing of one row. Since the sum of the illumination times Tec needed for a maximum gray level is equal to the maximum illumination time Tmax, we have the following equation: Ttot=m.(Tef+n.Tae)+Tmax, in which m represents the number of subscans. FIG. 1 corresponds to a binary decomposition of the illumination time. This binary division has a few problems which have already been identified.

One problem is contouring which stems from the proximity of two areas whose gray levels are very close but whose illumination times are decorrelated. The worst case, in the example in FIG. 1, corresponds to a transition between the levels 127 and 128. This is because the gray level 127 corresponds to an illumination for the first seven subscans SB1 to SB7, while the level 128 corresponds to the illumination of the eighth subscan SB8. Two areas of the screen placed one beside the other, having the levels 127 and 128, are never illuminated at the same time. When the image is static and the observer's eyes do not move over the screen, temporal integration takes place relatively well (if any flicker effect is ignored) and two areas with relatively close gray levels are seen. On the other hand, when the two areas move over the screen (or when the observer's eyes move), the integration time slot changes screen area and is shifted from one area to the other for a certain number of cells. The shift in the eye's integration time slot from an area of level 127 to an area of level 128 has the effect of integrating so that the cells are off over the period of one frame, which results in the appearance of a dark contour of the area. Conversely, shifting the eye's integration time slot from an area of level 128 to an area of level 127 has the effect of integrating so that the cells are lit to the maximum over the duration of one frame, which results in the appearance of a light contour of the area (which is less perceptible than the dark contour). This phenomenon is accentuated when the display works with pixels consisting of three (red, green and blue) elementary cells, since the contouring may be colored.

The phenomenon of contouring occurs at all level transitions where the switched illumination weights correspond to totally different time division groups. Switchings of high weight are more annoying than switchings of low weight because of their magnitude. The resulting effect may be perceptible to a greater or lesser extent depending on the switched weights and on their positions. Thus, the contouring effect may also occur with levels that are quite far apart (for example 63–128), but it is much less shocking for the eye as it then corresponds to a very visible level (or color) transition.

A problem of image flicker (known more often as Large Area Flicker) occurs when the total display time of the frame is 20 ms. Image flicker is particularly perceptible in image areas of moderate brightness whose illumination remains constant. This problem essentially stems from the eye's temporal filtering function which occurs at about 55 Hz.

Another, more general problem is the brightness of plasma display panels using this addressing mode. For the sake of clarity of the drawing, FIG. 1 is not to scale and does not give an exact proportion of the address time. In reality, complete addressing of a panel comprising 480 rows, for one subscan, may take about 1.2 ms, i.e. about 7% of the display time for a complete image displayed at a frequency of 60 Hz. For a panel operating at 50 Hz and comprising 525 rows, the address time, for one complete subscan, is about 1.3 ms, i.e. about 6.5% of the image display time. The actual display time for an image is therefore particularly reduced by the address time.

With regard to these three problems, various improvements in order to minimize these defects are known.

To remedy the problem of contouring, several solutions have been adopted. The main idea is to break up the high illumination weights so as to reduce the visual effects of high-weight transitions. FIG. 2 shows a solution in which 10 subscans are used, thereby resulting in an overall reduction in brightness of the panel. The maximum illumination time Tmax is then approximately 30% of the total image display time and the erasure and address time is about 70%.

To increase the number of subscans without reducing the overall brightness of the screen, it is known to use subscans common to two rows of the panel, thereby allowing the total number of subscans to be increased without reducing the actual image display time. European application EP-A-0 945 846 discloses a system for minimizing the error due to the simultaneous scanning of several pairs of rows by means of a multiple representation code. FIG. 3 shows an example of coding over 14 subscans, the display time of which corresponds to about 10 subscans. In the example shown in FIG. 3, the subscans of weight 1, 2, 4, 7, 13, 17, 25 and 36 are common to two rows at a time, the subscans of weight 5, 10, 20, 30, 40 and 45 being specific to each row.

Another solution for increasing the number of subscans consists in using a panel whose column electrodes are cut in the middle, thus defining two half-panels each having a reduced number of rows. This allows the address time to be reduced, the two half-panels being addressed independently of each other. This solution enables the overall brightness of the panel to be increased.

To remedy the problem of screen flicker, one improvement consists in using subscans divided into two groups of approximately equivalent weight. FIG. 4 shows the time division of an image into two groups each having a duration of 10 ms. Such a time division also minimizes the phenomenon of contouring. However, this type of time division requires many subscans (14 subscans in the case of FIG. 4), which reduces the gain in overall brightness produced by the use of two half-panels.

It may seem obvious to combine time division into two groups with simultaneous addressing of two rows so as to increase the brightness of the screen. However, such a combination must simultaneously meet various parameters:

- the illumination time for each cell must also be divided over the two groups of subscans;
- the illumination time corresponding to the subscans (conversely to the specific subscans) common to two cells must, also, be evenly be divided.

These two parameters cannot strictly be taken into account. However, it is expedient to do so as closely as possible. At the present time, no solution corresponding to an acceptable compromise is known.

SUMMARY OF THE INVENTION

The invention provides a solution which combines the technique of subscans common to two rows with division into two groups of subscans.

The subject of the invention is a method of displaying a video image on a plasma display panel comprising a plurality of discharge cells, in which each cell is illuminated for an illumination time by means of a plurality of subscans each having a specific duration, the subscans being divided into two successive time groups, and in which the illumination time for each cell is divided between the two groups, each group comprising first and second subscans, the first subscans being specific to each cell and the second subscans being common to at least two cells.

According to a first embodiment, the sum of the durations of all of the first subscans of the first group is greater than the sum of the durations of all of the first subscans of the second group and the sum of the durations of all of the second subscans of the first group is less than the sum of the durations of all of the second subscans of the second group. Such a division of the subscans makes it possible for there to be compensation between the two groups owing to the division of the subscans.

According to a second embodiment, for each cell, the difference in illumination time between the first and second groups is compensated for between the first and second subscans so that the overall difference between the illumination times for the first and second groups is below a threshold. This involves the durations being dynamically divided over the first and second subscans so that any imbalance in the first subscans is compensated for by means of the second subscans. The second embodiment is independent of the first one, but may advantageously be combined with it.

The invention also relates to a plasma display panel comprising illumination cells, and in which the cells are illuminated according to the method of the invention.

The invention will be more clearly understood and further features and advantages will become apparent on reading the description which follows, the description referring to the appended drawings among which:

For representational reasons, the time division of the subscans uses significant proportions which do not correspond to an exact linear scale.

Figure 1:
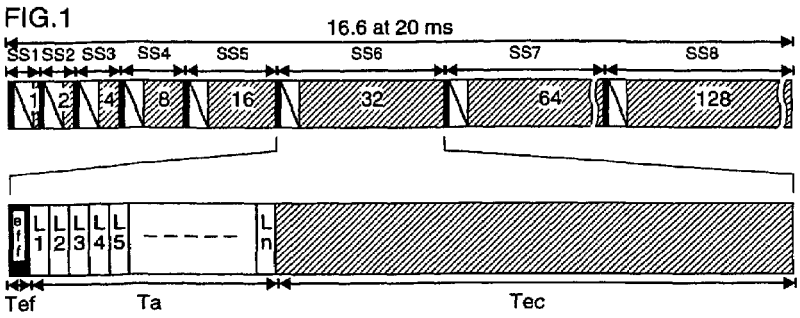
FIGS. 1 to 4 show subscan time divisions during the displaying of an image according to the prior art.
Figure 2:
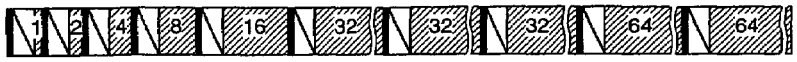
Figure 3:
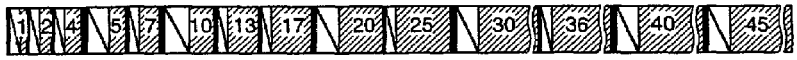
Figure 4:
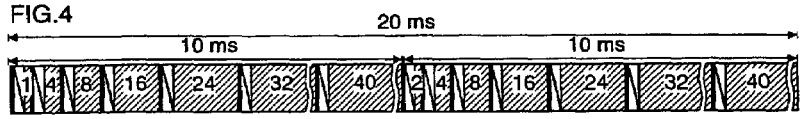
Figure 5:
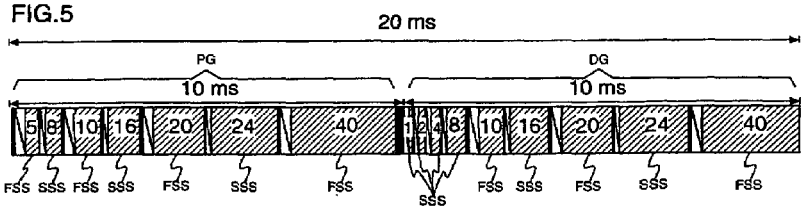
FIGS. 5 and 6 show subscan time divisions during the displaying of an image according to the invention.

FIG. 5 shows a first preferred time division implementing the invention. This time division comprises first subscans FSS specific to each row, which subscans allow each cell of the screen to be addressed individually. In the preferred example, there are seven first subscans FSS with which the respective illumination weights 5, 10, 10, 20, 20, 40 and 40 are associated. Such a selection produces a maximum difference value of 145 over 255 gray levels. A statistical study on video images makes it possible to determine that the probability of error due to the maximum difference value is less than 5%.

Second subscans SSS address two adjacent lines simultaneously. In the preferred example, there are eight second subscans SSS with which the respective weights 1, 2, 4, 8, 8, 16, 16, 24, 24 are associated. A person skilled in the art may note that there is a loss of resolution over the high luminance values, the maximum level after coding being 244 and not 255. However, such a difference over the high brightness levels is not visible if an appropriate compression is carried out over the high levels. It is also possible to make a transposition over 245 levels instead of 256 during the gamma correction made previously.

The first and second subscans FSS and SSS are divided into a first group FG and a second group SG. The overall period (illumination time and address time) for each group is approximately the same—in this example, the difference is of the order of 1%. Moreover, their illumination weights are divided equivalently, the first group FG having the illumination weights 5, 8, 10, 16, 20, 24 and 40 and the second group having the illumination weights 1, 2, 4, 8, 10, 16, 20, 24 and 40. The division between the first subscans FSS and second subscans SSS is slightly imbalanced, but the imbalance is made in favor of the first subscans FSS in the first group and in favor of the second subscans SSS in the second group SG. The method of the invention will use the imbalances between the first and second subscans FSS and SSS so as to mutually compensate them in order for the final result of the coding to correspond to the first and second groups FG and SG being almost balanced.

According to a first method of implementation, the code in FIG. 5 is used. The gray levels sharing common addressing are separated into a common part and into specific parts according to a known technique. The division between the groups is then carried out as follows:

the specific parts corresponding to the first subscans are separated into two parts—if the separation results in an imbalance, then the imbalance is made in favor of the first group;

the common part corresponding to the second subscans is separated into two parts—if the separation results in an imbalance, then the imbalance is made in favor of the second group, the weights equal to 24 always being activated or inactivated simultaneously.

It should be noted that the separation of the first subscans may result in an imbalance of 15 in favor of the first group and that the separation of the second subscans may result in an imbalance of 15 in favor of the second group. However, owing to the division, the actual imbalance is greater than 10 only in 15% of the possible cases and is less than or equal to 5 in 53% of the cases.

As an illustration, we use, for example, the coding method disclosed in application EP-A-0 945 846 on page 5, line 39 to page 6, line 34 with a coefficient $\alpha=5/16$ for simultaneously encoding two gray levels GL1 and GL2 having a common part CL and a specific part SL1 and SL2 specific to each gray level.

Example 1: GL1=100 and GL2=128

GL2−GL1=28

Rounded minimization error difference: D=30

Corrected values to be encoded: GL1=99 and GL2=129

SL2=D+αGL1=60

SL1=αGL1=30

CL=69.

Hence the following codings of the specific and common values:

SL2=10+10+20+20

SL1=10+20

CL=1+4+8+8+24+24.

This amounts to coding the GL1 and GL2 values as follows:

GL1: 8+20+24=52/1+4+8+10+24=47

GL2: 8+10+20+24=62/1+4+8+10+20+24=67.

Example 2: GL1=62 and GL2=136

GL2−GL1=74

Rounded minimization error difference: D=75

Corrected values to be encoded: GL1=61 and GL2=136

SL1=αGL1=15

SL2=D+αGL1=90

CL=46.

Hence the following codings of the specific and common values:

SL2=10+40+40

SL1=5+10

CL=2+4+8+16+16.

This amounts to coding the GL1 and GL2 values as follows:

GL1: 5+10+16=31/2+4+8+16=30

GL2: 10+16+40=66/2+4+8+16+40=70.

The examples described above both have differences between the first and second groups which are less than 5. Unfortunately, as was indicated previously, this example has, on the one hand, a limitation in the resolution and, on the other hand, a maximum imbalance possibly with a weight of 15.

Figure 6:
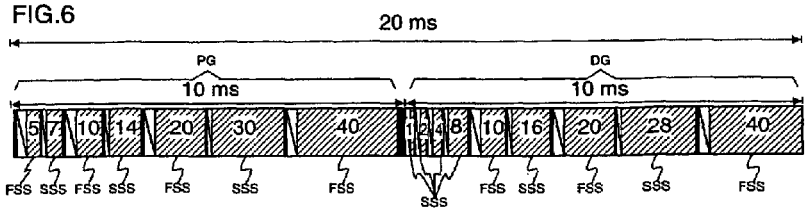

FIG. 6 shows another preferred time division for which a method of implementation will now be described in detail. This time division comprises first subscans FSS specific to each row, which subscans allow each cell of the screen to be addressed individually. In the preferred example, there are seven first subscans FSS with which the respective illumination weights 5, 10, 10, 20, 20, 40 and 40 are associated. Such a selection produces a maximum difference value of 145 over 256 gray levels. A statistical study on video images makes it possible to determine that the probability of error due to the maximum difference value is less than 5%.

Second subscans SSS address two adjacent lines simultaneously. In the preferred example, there are nine second subscans SSS with which the respective weights 1, 2, 4, 7, 8, 14, 16, 28, 30 are associated.

The first and second subscans FSS and SSS are divided into a first group FG and a second group SG. The overall period (illumination time and address time) for each group is approximately the same—in our example the difference is of the order of 0.5%. Moreover, the illumination weights are divided equivalently, the first group FG having the illumination weights 5, 7, 10, 14, 20, 30 and 40 and the second group having the illumination weights 1, 2, 4, 8, 10, 16, 20, 28 and 40. The division between the first subscans FSS and the second subscans SSS is slightly imbalanced, but the imbalance is made in favor of the first subscans FSS in the first group FG and in favor of the second subscans SSS in the second group SG. The method of the invention will use the imbalances between the first and second subscans FSS and SSS so as to mutually compensate them in order for the final result of the coding to correspond to the first and second groups FG and SG being almost balanced.

The method of coding the gray levels for each pair of cells will now be described with the aid of the algorithm in FIG. 7. The algorithm starts with two known gray levels GL1 and GL2 associated with a first cell and a second cell respectively, said cells having common subscans.

In a first step 101, the absolute value of the difference between GL1 and GL2 is calculated. This difference |GL1−GL2| is then rounded to five in order to minimize the error, the rounded difference being called D hereafter.

In a second step 102, the values V1 and V2 corresponding to the levels GL1 and GL2 respectively are calculated. These values V1 and V2 are determined, on the one hand, according to the rounding performed on the difference |GL1−GL2| and, on the other hand, according to the minimum and maximum values of GL1 and GL2. In the example described, the rounding of the difference and the modification of V1 and V2 are carried out according to the following table:

| Last digit of IGL1 − GL2I | D | V1 | V2 |
|---|---|---|---|
| 0 | 0 | Max(GL1, GL2) | Min(GL1, GL2) |
| 1 | 0 | Max(GL1, GL2) − 1 | Min(GL1, GL2) |
| 2 | 0 | Max(GL1, GL2) − 1 | Min(GL1, GL2) + 1 |
| 3 | 5 | Max(GL1, GL2) + 1 | Min(GL1, GL2) − 1 |
| 4 | 5 | Max(GL1, GL2) | Min(GL1, GL2) − 1 |
| 5 | 5 | Max(GL1, GL2) | Min(GL1, GL2) |
| 6 | 5 | Max(GL1, GL2) − 1 | Min(GL1, GL2) |
| 7 | 5 | Max(GL1, GL2) − 1 | Min(GL1, GL2) + 1 |
| 8 | 0 (up. ten.) | Max(GL1, GL2) + 1 | Min(GL1, GL2) − 1 |
| 9 | 0 (up. ten.) | Max(GL1, GL2) | Min(GL1, GL2) − 1 |

After calculating V1 and V2, a first test 103 is carried out. The first test 103 checks if the rounded difference D is greater than the maximum difference $D_{MAX}$ which in our preferred example is equal to 145. If D is greater than $D_{MAX}$, then a third step 104 is carried out, otherwise a second test 105 is carried out.

The second test 105 checks if the rounded difference D is a multiple of 20. To simplify implementation, it is possible to test only if D is a multiple of 4. If D is a multiple of 20 then a fourth step 106 is carried out, otherwise a third test 107 is carried out.

The third test 107 checks if the rounded difference D is a multiple of 10. To simplify implementation, it suffices to check if D is a multiple of 2. If D is a multiple of 2, then a fifth step 108 is carried out, otherwise a fourth test 109 is carried out.

The fourth test 109 checks if the rounded difference plus 5 is a multiple of 20. To simplify implementation, it suffices to check if the two low-rate bits of D are both equal to 1. If the rounded difference plus 5 is a multiple of 20, then a sixth step 110 is carried out, otherwise a seventh step 111 is carried out.

In practice, the first to the fourth tests 103, 105, 107 and 109 may be carried out successively or simultaneously, depending on the technological choices made by a person skilled in the art. Likewise, the third to the seventh steps 104, 106, 108, 110 and 111 may be carried out either conditionally, according to the results of the first to the fourth tests 103, 105, 107 and 109, or simultaneously, the result of the tests serving merely to choose the result of one of the steps after execution.

The third to the seventh steps 104, 106, 108, 110 and 111 are used to divide the rounded difference D over the first and second groups FG and SG. In this example, the rounded difference is divided so as to have the smallest possible imbalance. Hereafter, the notation D1 corresponds to that part of the rounded difference D which is placed in the first group FG and the notation D2 corresponds to that part of the rounded difference D which is placed in the second group SG.

The third step 104 assigns the maximum values $D1_{MAX}$ and $D2_{MAX}$ to D1 and D2—in our example, $D1=D1_{MAX}=75$ and $D2=D2_{MAX}=70$. After this third step 104, an eighth step 112 recalculates the value of V1 so that it is equal to $V2+D_{MAX}$. A person skilled in the art will readily understand that the third step 104 and the eighth step 112 may be carried out in any order.

The fourth step 106 serves to divide the difference D evenly between the first and second groups FG and SG, so that D1=D2=D/2.

The fifth step 108 divides the difference D between the first and second groups FG and SG with an imbalance of 10 in favor of the first group FG. After this fifth step 108, we have D1=(D/2)+5 and D2=(D/2)−5.

The sixth step 110 divides the difference D between the first and second groups FG and SG with an imbalance of 5 in favor of the second group SG. After this sixth step 110, we have D1=(D−5)/2 and D2=D1+5.

The seventh step 111 divides the difference D between the first and second groups FG and SG with an imbalance of 5 in favor of the first group FG. After this seventh step 11, we have D1=(D+5)/2 and D2=D1−5.

Depending on the results of the first to the fourth tests 103, 105, 107 and 109, a ninth step 113 is carried out after one of the fourth to the eighth steps 106, 108, 110, 111 and 112. The ninth step 113 serves to determine which common value C1 must be determined in order to best compensate for the imbalances due to the division of the rounded difference D over the parts D1 and D2, the common value C1 corresponding to the first group FG. Since the first group does not enable all the values to be coded, it is necessary to calculate the optimum value of C1 which will be corrected during the actual encoding. The optimum value of C1 corresponds to the result of the ((V1+V2)/2−D1)/2 operation which is rounded down to the lower integer in the preferred example.

After the ninth step 113, a tenth step 114 for encoding the C1 and C1+D1 values over the subscans of the first group FG. During this tenth step 114, the value of C1 will also be refined. One method consists in determining all the possible encodings of the C1 and C1+D1 values for the optimum value of C1. It is not possible to encode with the optimum value of C1, then it is endeavored to encode with the values corresponding to C1±1 and then to C1±2 until at least one coding which works is obtained. After the various possible codings have been compared, the final value of C1 is determined as being the value which corresponds, for example, to an encoding over a maximum number of subscans. The calculation of C2 is then performed quite simply by subtraction: C2=V1−(C1+D). A person skilled in the art may note that the imbalance between common part and difference is compensated for during the calculation of C2. This tenth step 114 also delivers three words SM1, Sm1 and COM1 which correspond, for the first group FG, respectively to the coding of the first subscans FSS specific to the highest gray level, to the coding of the first subscans FSS specific to the lowest gray level and to the coding of the second subscans SSS common to the two gray levels. The three words SM1, Sm1 and COM1 correspond to the value of C1 selected.

An eleventh step 115 for encoding the C2 and C2+D2 values over the subscans of the second group SG is then carried out. A person skilled in the art may apply a known technique for carrying out this encoding or may use the algorithm described below with reference to FIG. 8.

To end, a twelfth step 116 carries out a formatting operation on the encoded values. This formatting serves to put the encoded values into correspondence with the gray levels according to the highest gray level.

An encoding algorithm will now be described with reference to FIG. 8. The algorithm described applies to the eleventh step 115. A thirteenth step 201 encodes the D2+C2 value. The encoding carried out consists in coding the D2+D2 value over all of the subscans FSS and SSS of the second group SG, giving precedence to the subscans corresponding to the low illuminance weights. After encoding, a nine-bit word is obtained, the word being able to split into a first word SPEMAX corresponding to the activation of the first subscans FSS of the second group SG and into a second word COMMAX corresponding to the activation of the second subscans SSS of the second group SG.

A fourteenth step 202 encodes the D2 and C2 values separately. D2 is encoded as a third word SPEMIN corresponding to the activation of the first subscans FSS of the second group SG. C2 is encoded as a fourth word COMMIN corresponding to the activation of the second subscans SSS of the second group SG.

After the fourteenth step 202, a test 203 is carried out. The test 203 checks if the part D2 of the second group is greater than the value corresponding to the first word SPEMAX. If D2 is greater than the value of SPEMAX, then a fifteenth step 204 is carried out, otherwise a sixteenth step 205 is carried out.

The fifteenth and sixteenth steps 204 and 205 are assigning steps which determine three words SM2, Sm2 and COM2 which correspond, for the second group SG, respectively to the coding of the first subscans FSS specific to the highest gray level, to the coding of the first subscans FSS specific to the lowest gray level and to the coding of the second subscans SSS common to the two gray levels.

The fifteenth step 205 assigns the word SPEMAX to the word SM2, a zero word to the word SM2 and the word COMMIN to the word COM2.

The sixteenth step 205 assigns the word SPEMAX to the word SM2, a word equivalent to the difference between the value of SPEMAX and the D2 value to Sm2 and the word COMMAX to the word COM2.

Figure 9:
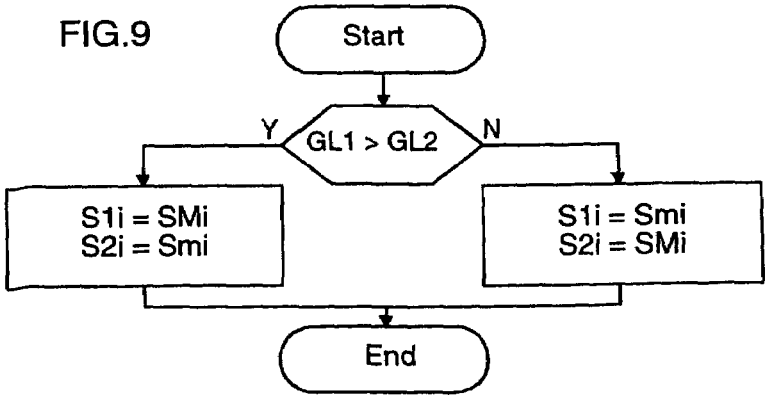

FIG. 9 shows schematically the execution of the twelfth step 116. Depending on a highest gray level test, the words SMi and Smi are assigned either to the gray level GL1 or to the gray level GL2.

Figure 7:
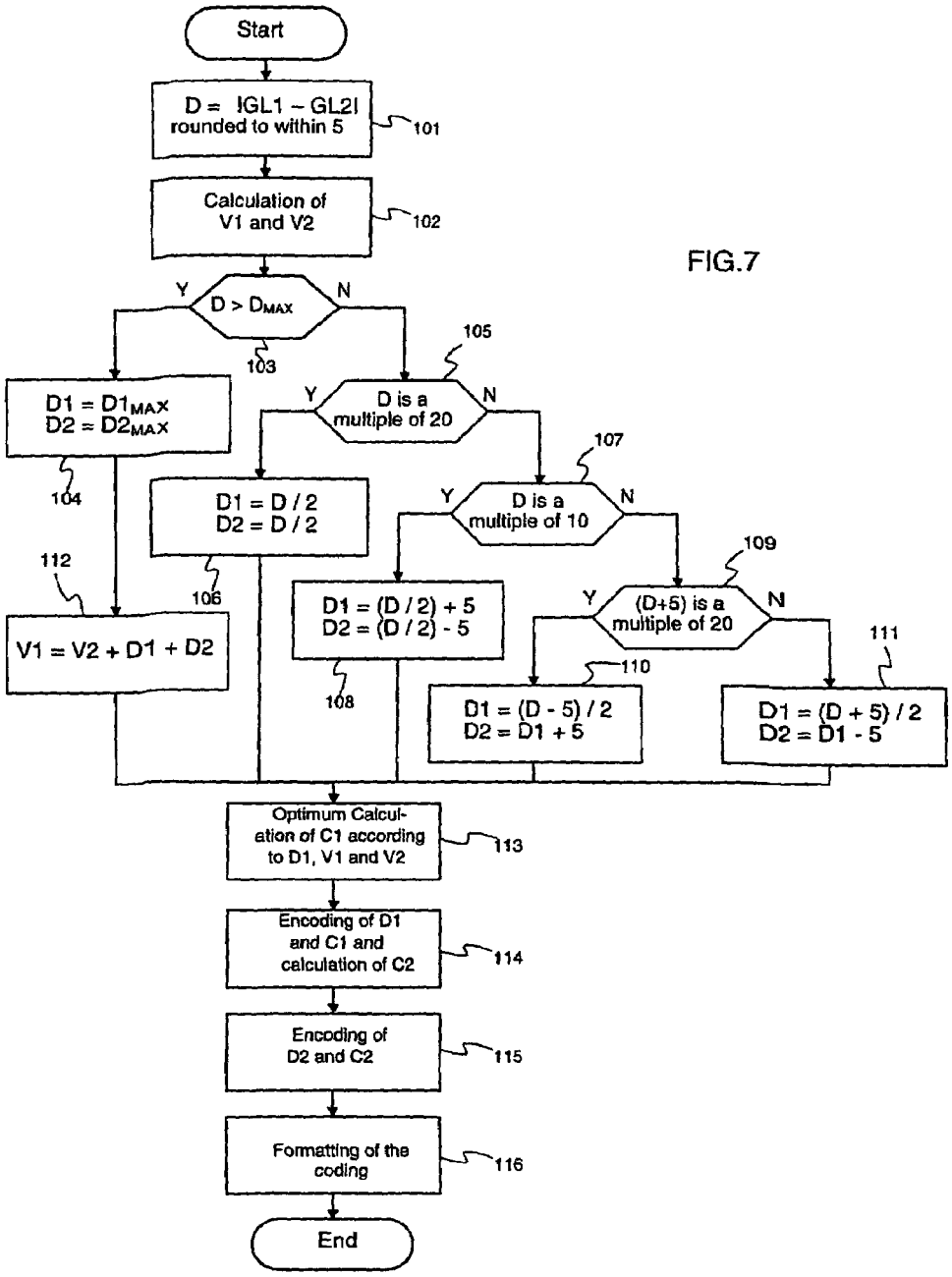
FIGS. 7 to 9 illustrate a gray level coding algorithm according to the invention.
Figure 8:
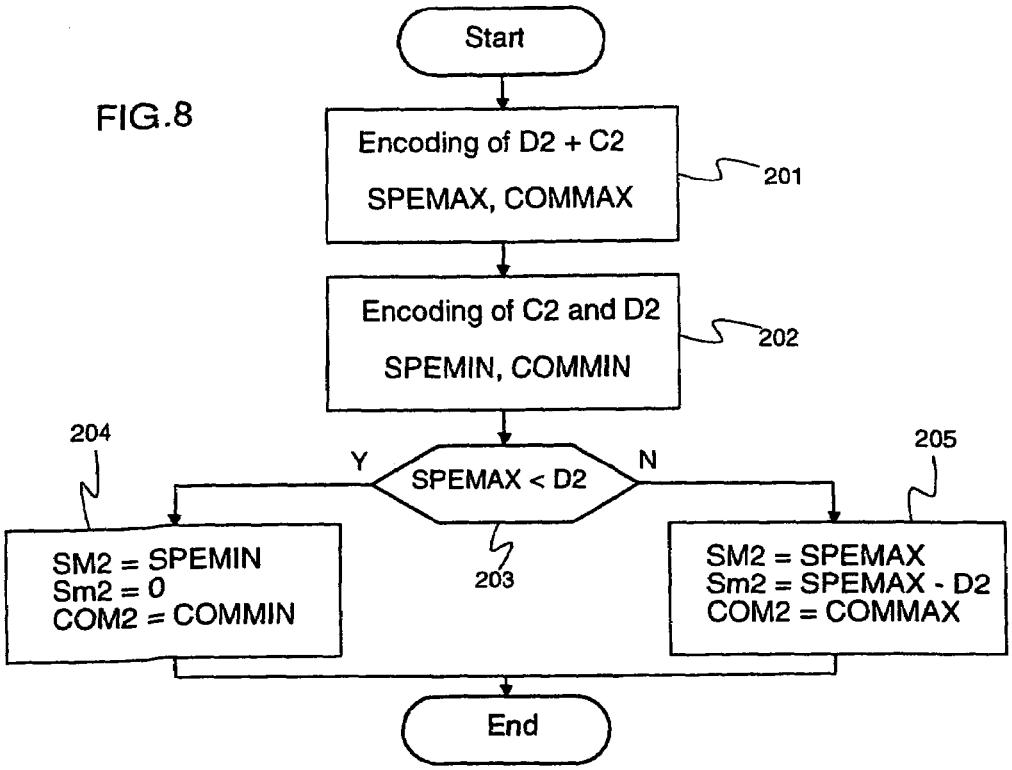

The algorithm composed from the algorithms in FIGS. 7 to 9 is repeated for each pair of cells whose second subscans SSS are common.

To make the operation of the method forming the subject of the invention more clearly understood, a few application examples will now be described. For greater clarity, the various words corresponding to the coding of the subscans are represented in the form of a sum of values, each value corresponding to the activation of the subscan associated with said value.

First example: GL1=130, GL2=124
|GL1−GL2|=6=>D=5, V1=130 and V2=125
D1=5 and D2=0
Optimum value of C1=61
Possible encodings of C1 and of D1+C1 over the first group:
61=7+10+14+30/66=5+7+10+14+30
61=7+14+40/66=5+7+14+40.
The first case is preserved and the following obtained:
SM1=5+10; Sm1=10; COM1=7+14+30; and C2=64.
Encoding of C2 and of D2+C2 over the second group:
D2+C2=61=1+2+4+8+10+16+20
SPEMAX=10+20>D2
COMMAX=1+2+4+8+16
COMMIN not encodable
SM2=Sm2=10+20
COM2=1+2+4+8+16.
Since GL1 is greater than GL2, then:
S11=SM1; S12=SM2; S21=Sm1; S22=Sm2
Code(GL1)=5+7+10+14+30=66/1+2+4+8+10+16+20=64
Code(GL2)=7+10+14+30=61/1+2+4+8+10+16+20=64.
Second example: GL1=62, GL2=130
|GL1−GL2|=68=>D=70; V1=131; V2=61
D1=40 and D2=30.
Optimum value of C1=28.
Possible encodings of C1 and D1+C1 over the first group:
28 and 68 are not encodable
29=5+10+14/69=5+10+14+40
27=7+20/67=7+20+40.
The case in which C1=27 is preserved and then:
SM1=5+10+40; Sm1=5+10; COM1=14; and C2=32.
Encoding of C2 and D2+C2 over the second group:
D2+C2=62=8+10+16+28
SPEMAX=10<D2
COMMAX=8+16+28
SPEMIN=10+20
COMMIN=4+28
SM2=SPEMIN=10+20; Sm2=0
COM2=COMMIN=4+28.
Since GL1 is less than GL2, then:
S11=Sm1; S12=Sm2; S21=SM1; S22=SM2
Code(GL1)=5+10+14=29/4+28=32
Code(GL2)=5+10+14+40=69/4+10+20+28=62.

In these two examples, a person skilled in the art may see that the various pairs of gray levels GL1 and GL2 are always distributed in a homogenous manner overall. However, the imbalances between the first subscans (and between the second subscans) are greater during coding than during the preceding example and are independent of the final imbalance between the groups. A statistical study shows that in 85% of the cases (in total, 65 536 cases), the difference in weight between the two groups does not exceed 5. In addition, in no case does the difference in weight between the two groups exceed 10.

Of course, a person skilled in the art will notice that there is a loss of resolution for the case in which there is too great a difference in gray level. This defect stems from the common use of the same row to address two cells and it is not corrected in the present invention.

Figure 10:
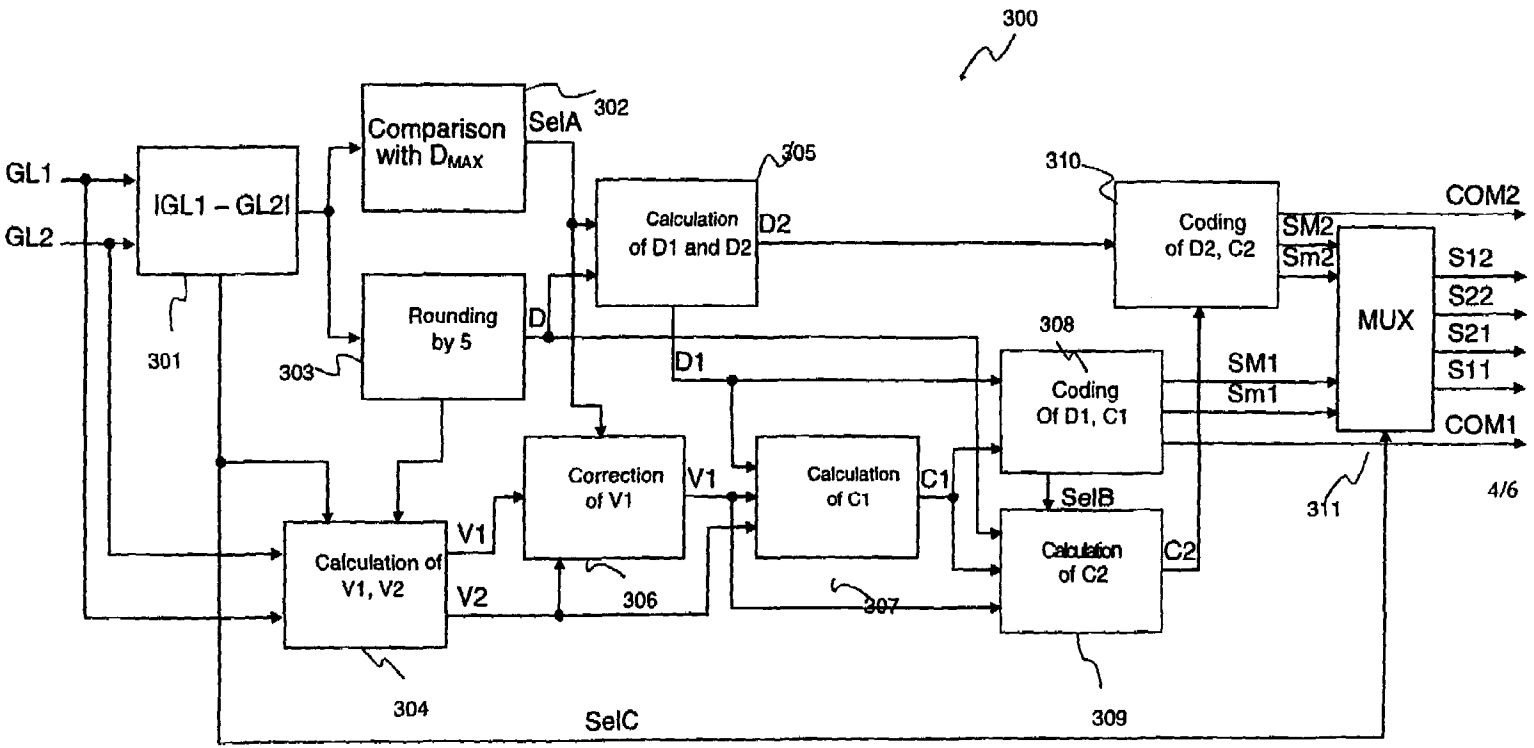
FIG. 10 shows a processing circuit using the coding algorithm according to the invention.

A preferred embodiment of the invention will now be described with reference to FIGS. 10 to 15. FIG. 10 shows an encoding device 300 according to the invention, used to encode the gray levels GL1 and GL2 according to the algorithms corresponding to FIGS. 7 to 9. A plasma display panel may have one or more devices of this type depending on the type of calculation needed and the number of cells present in said panel.

The encoding device 300 has first and second input buses, for example eight-bit buses, for receiving the gray levels GL1 and GL2 corresponding to two cells sharing the same second subscans SSS. The gray levels GL1 and GL2 may come either from an image memory containing all of the image or from a decoding device which decodes a video signal and translates it into a gray level for each cell. The encoding device 300 has six output buses which deliver the words COM1, COM2, S11, S12, S21 and S22 which correspond to on or off codes for the second subscans SSS of the first and second groups FG and SG, for the first subscans FSS of the first and second groups FG and SG associated with the first gray level GL1 and for the first subscans FSS of the first and second groups FG and SG associated with the second gray level GL2, respectively.

The encoding device 300 includes a difference circuit 301 which receives the two gray levels GL1 and GL2 to be encoded and delivers onto a first output the absolute value of the difference between GL1 and GL2. In addition, on a second output of said difference circuit 301, an information bit SelC indicates which gray level, GL1 or GL2, is to be considered as greater than the other.

Figure 11:
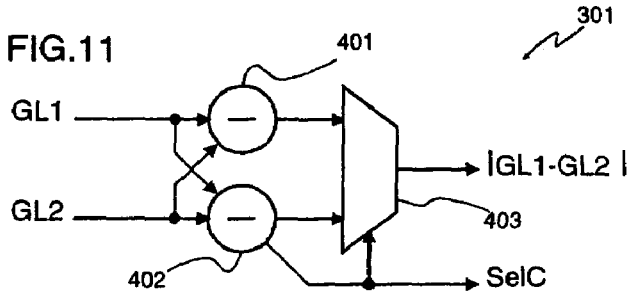
FIGS. 11 to 15 show details of the circuit in FIG. 10.
Figure 12:
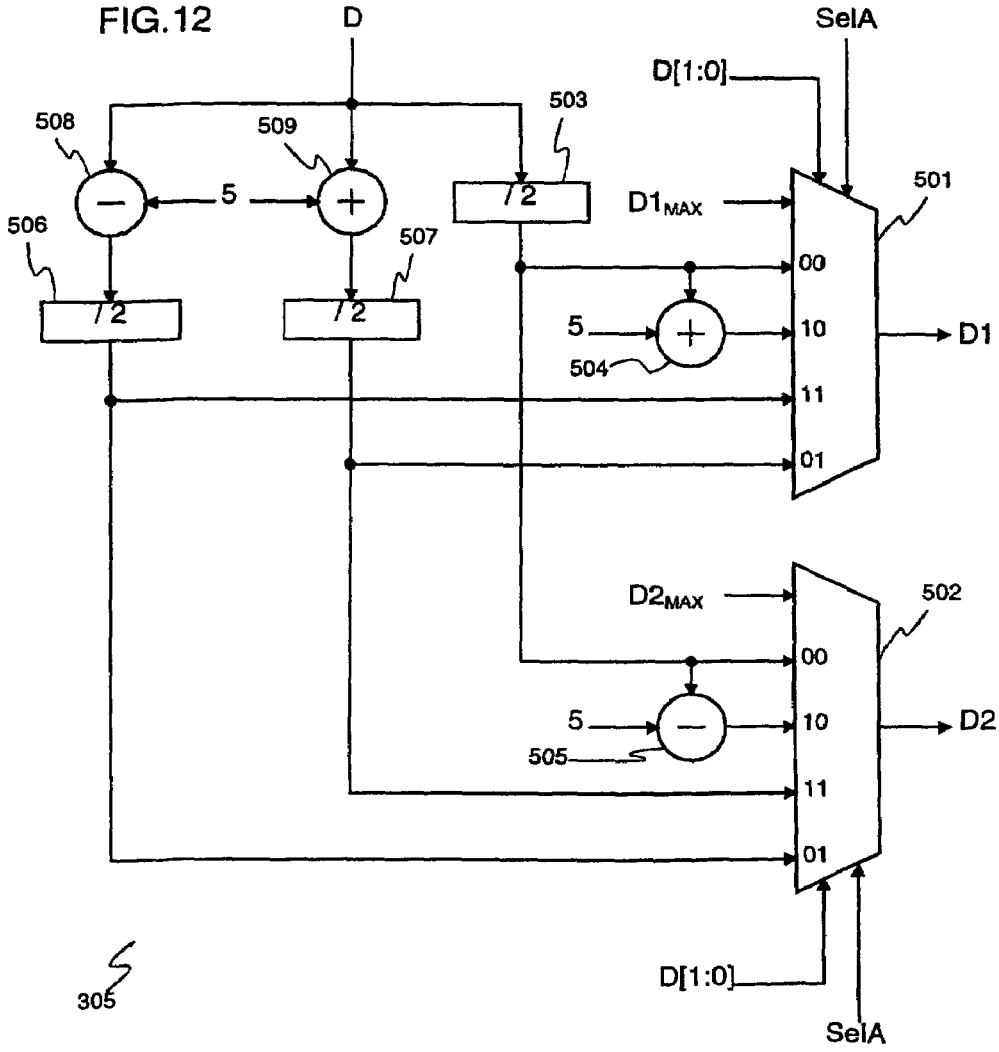
Figure 13:
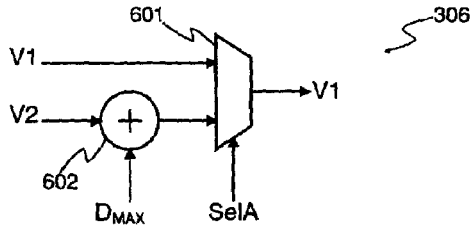
Figure 14:
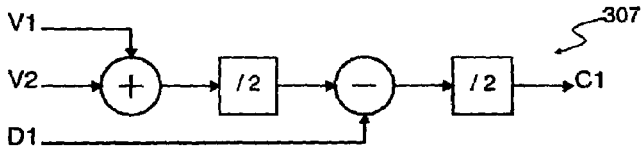
Figure 15:
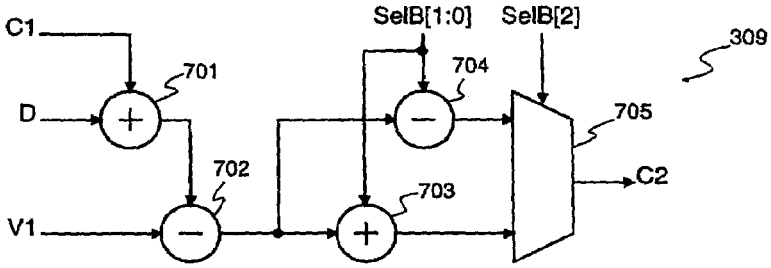

The difference circuit 301 is made up, for example, as indicated in FIG. 11. First and second subtraction circuits 401 and 402 receive the gray levels GL1 and GL2 on opposed inputs so that the first subtraction circuit 401 delivers the difference GL1−GL2 on a result output and the second subtraction circuit 402 delivers the difference GL2−GL1 on a result output. The second subtraction circuit also has an overflow output (also known as a retain output) which makes it possible to know if the result of the subtraction is positive or negative and therefore delivers the information bit SelC. A multiplexer 403 receives the information bit SelC on a selection input and has first and second inputs connected to the result outputs of the first and second subtraction circuits 401 and 402, respectively. The multiplexer 403 selects the positive result according to the information bit SelC so that the output of the multiplexer 403 corresponds to the output of the difference circuit 301.

The encoding device 300 also includes a comparison circuit 302 which compares the absolute value of the difference |GL1−GL2| with the maximum difference value $D_{MAX}$ which is fixed by the subscans used. The comparison circuit 302 delivers a selection signal SelA which corresponds to the result of the first test 103. A person skilled in the art may note that it is not necessary to round to 5 in order to make this comparison as the final result remains equivalent before or after rounding.

A rounding circuit 303 receives the absolute value of the difference |GL1−GL2| for rounding it to 5. A first output delivers the rounded difference D and a second output delivers a rounding control bus. The rounding control bus indicates how the values V1 and V2 must be modified. The rounding circuit 303 may be made by means of a look-up table, one part of the output bits of which corresponds to the rounded difference D and another part of the output bits corresponds to a control code. A person skilled in the art will note that the cooperation between the difference circuit 301 and the rounding circuit 303 carries out the function of the first step 101.

A first calculation circuit 304 receives the gray levels GL1 and GL2 and delivers the values V1 and V2 which will be used for the coding. For this purpose, the first calculation circuit 304 receives the information bit SelC for making the highest level, GL1 or GL2, correspond to the value V1 and the lowest level GL1 to the value V2. The first calculation circuit 304 also receives the control bus coming from the rounding circuit 303 in order to perform, if necessary, an addition or a subtraction of one unit on V1 and/or V2.

A second calculation circuit 305 receives the rounded difference D coming from the rounding circuit 303 and the selection signal SelA, these being used to deliver the difference parts D1 and D2. The second calculation circuit 305 advantageously carries out steps 104, 106, 108, 110 and 111. For this purpose, the second calculation circuit 305 is described in greater detail with the aid of FIG. 12.

The second calculation circuit 305 includes first and second multiplexers 501 and 502. Each of the first and second multiplexers 501 and 502 has an output bus and five input buses switched according, on the one hand, to the selection signal SelA and, on the other hand, to two low-weight bits D[1:0] of the rounded difference D. The first and second multiplexers 501 and 502 select the first and second difference parts D1 and D2, respectively, according to the results of the first to fourth tests 103, 105, 107 and 109. A person skilled in the art may note that the second to fourth tests 105, 107 and 109 are carried out simultaneously on the basis of the two low-weight bits D[1:0] of the rounded difference D.

When the selection signal SelA indicates that the difference D is greater than the maximum difference $D_{MAX}$, then the first and second multiplexers 501 and 502 connect their output buses to their first inputs which receive the $D1_{MAX}$ and $D2_{MAX}$ values, respectively, so that $D1=D1_{MAX}$ and $D2=D2_{MAX}$. When the selection signal SelA indicates that the difference D is less than or equal to the maximum difference $D_{MAX}$, then the first and second multiplexers 501 and 502 connect their output buses to their second to fifth inputs according to the two low-weight bits D[1:0] of the rounded difference D.

A first division circuit 503 receives the value D from an input and delivers the value D/2 to an output. The output of the first division circuit 503 is connected to the second inputs of the first and second multiplexers 501 and 502 so that when the two low-weight bits D[1:0] of the rounded difference D are equal to the value 00 (D a multiple of 4), then D1=D2=D/2.

A first addition circuit 504 has first and second inputs and one output, the first input being connected to the output of the first division circuit 503 and the second input receiving the value 5 so that the output delivers the value (D/2)+5. The output of the first addition circuit 504 is connected to the third input of the first multiplexer 501 so that when the two low-weight bits D[1:0] of the rounded difference D are equal to the value 10 (D a multiple of 2), then D1=(D/2)+5. A first subtraction circuit 505 has first and second inputs and one output, the first input being connected to the output of the first division circuit 503 and the second input receiving the value 5 so that the output delivers the value (D/2)−5. The output of the first subtraction circuit 505 is connected to the third input of the second multiplexer 502 so that when the two low-weight bits D[1:0] of the rounded difference D are equal to the value 10 (D a multiple of 2), then D2=(D/2)−5.

The second calculation circuit 305 also has second and third division circuits 506 and 507 having one input and one output, the output delivering the value present at the input divided by two. A second subtraction circuit 508, having two inputs and one output, receives the value D on one input and the value 5 on the other input so that the output delivers a value equal to D−5. The output of the second subtraction circuit 508 is connected to the input of the second division circuit 506 so that the output of the second division circuit 506 delivers the value (D−5)/2. The output of the second division circuit 506 is connected, on the one hand, to the fourth input of the first multiplexer 501 and, on the other hand, to the fifth input of the second multiplexer 502 so that, on the one hand, when the two low-weight bits D[1:0] of the rounded difference D are equal to the value 11 (D+5 a multiple of 20), then D1=(D−5)/2 and, on the other hand, when the two low-weight bits D[1:0] of the rounded difference D are equal to the value 01 (D+5 not a multiple of 20), then D2=(D−5)/2.

A second addition circuit 509, having two inputs and one output, receives the value D on one input and the value 5 on the other input so that the output delivers a value equal to D+5. The output of the second addition circuit 509 is connected to the input of the third division circuit 507 so that the output of the third division circuit 507 delivers the value (D+5)/2. The output of the third division circuit 507 is connected, on the one hand, to the fifth input of the first multiplexer 501 and, on the other hand, to the fourth input of the second multiplexer 502 so that, on the one hand, when the two low-weight bits D[1:0] of the rounded difference D are equal to the value 01 (D+5 not a multiple of 20), then D1=(D+5)/2 and that, on the other hand, when the two low-weight bits D[1:0] of the rounded difference D are equal to the value 11 (D+5 a multiple of 20), then D2=(D+5)/2.

A person skilled in the art may note that the division circuits 503, 506 and 507 are dummy circuits as all that is required is to shift the input value by one bit, that is to say to make a shifted bus connection. A person skilled in the art may also advantageously produce simplified addition circuits 504 and 509 and subtraction circuits 505 and 508 as the operations are limited to the value 5.

The encoding device 300 also includes a correction circuit 306 which receives the values V1 and V2 coming from the first calculation circuit 304 and the selection signal SelA coming from the comparison circuit 302 and which delivers the value V1 possibly corrected as indicated in the eighth step 112. The correction circuit 306, described in FIG. 13, comprises a multiplexer 601 and an addition circuit 602. The addition circuit 602 adds the value V2 to the value $D_{MAX}$. The multiplexer 601 chooses, according to the selection signal SelA, if the new value of V1 is equal to the value V1 calculated in the first calculation circuit 304 or to the corrected value equal to $V2+D_{MAX}$.

A third calculation circuit 307 calculates the value C1 detailed in the ninth step 113. The third calculation circuit 307 receives the values D1, V1 and V2 and delivers the value C1=((((V1+V2)/2)−D1)/2. A person skilled in the art may, for example, use a circuit of the type shown in FIG. 14.

The encoding device 300 includes a first encoding circuit 308 which receives the values C1 and D1 and which delivers, on the one hand, three coding words SM1, Sm1 and COM1 and, on the other hand, correction information SelB. The encoding method used corresponds to that described for the tenth step 114. For practical reasons, a look-up table which already has the precalculated results is used. The look-up table consists, for example, of a memory organized into 14-bit words, 4 bits corresponding to SM1, 4 bits corresponding to Sm1, 3 bits corresponding to COM1 and 3 bits corresponding to SelB. The memory comprises 12 address lines, 7 bits for the value C1 and 5 bits for the value D1. Great care will be taken not to use to two low-weights of the value D1 which deliver unnecessary redundancy for the encoding carried out. The memory is loaded with the words to be obtained according to the various configurations of the values C1 and D1, at the addresses defined by the values C1 and D1. Optionally, a person skilled in the art may use only 4 bits to code the value D1, provided that it is coded differently. The correction information SelB includes a sign bit and two significant bits which indicate if the value C2 has to be corrected to within ±3.

A fourth calculation circuit 309 calculates C2. Contrary to what is described in the algorithm, it is not C1 which is corrected but C2, for reasons of calculation speed. The fourth calculation circuit 309 is described in greater detail in FIG. 15.

The fourth calculation circuit 309 includes a first addition circuit 701 receiving the values C1 and D and delivering the sum C1+D. A first subtraction circuit 702 subtracts the sum C1+D from the value V1 and delivers the intermediate result V1−(C1+D). A second addition circuit 703 and a second subtraction circuit 704 receive the intermediate result on one input and the two significant bits SelB[1:0] of the correction information SelB on another input and deliver an intermediate result corrected by addition or subtraction, respectively. A multiplexer 705 selects the value C2 from the corrected results according to the sign SelB[2] of the correction information.

The encoding device 300 includes a second encoding circuit 310 which receives the values C2 and D2 and which delivers the three coding words SM2, Sm2 and COM2. The encoding method used corresponds to that described for the eleventh step 115. For practical reasons, a look-up table which already has the precalculated results is used. The look-up table consists, for example, of a memory organized into 12-bit words, 3 bits corresponding to SM2, 3 bits corresponding to Sm2 and 6 bits corresponding to COM2. The memory comprises 13 address lines, 8 bits for the value C2 and 5 bits for the value D2. Great care will be taken not to use two low-weight bits of the value D2 which deliver unnecessary redundancy for the encoding carried out. The memory is loaded with the words to be obtained according to the various configurations of the values C2 and D2, at the addresses defined by the values C2 and D2. Optionally, a person skilled in the art may use only 4 bits to code the value D2, provided that it is coded differently.

A multiplexing circuit 311 makes the words SM1, Sm1, SM2 and Sm2 correspond to the words S12, S22, S21 and S11 according to the information bit SelC.

Figure 16:
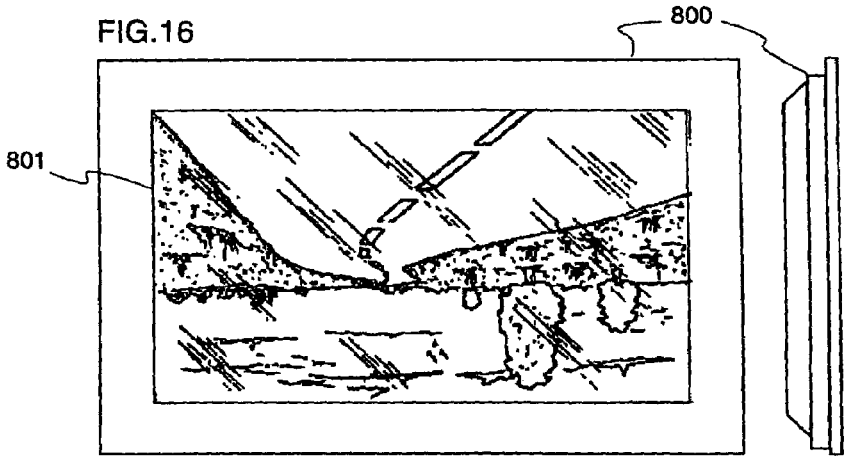
FIG. 16 shows a plasma display panel implementing the invention.

The encoding device 300 is then incorporated into a display panel 800 in order to allow the image 801 to be displayed, as shown in FIG. 16.

Such an encoding device 300 may be produced in various embodiments. As an example, if a person skilled in the art estimates that the calculation time is too short, it is possible, for example, to adopt a pipeline-type structure. For this purpose, the memory registers may, for example, be added to the various links between the circuits in FIG. 10 so as to truncate the calculation using a known technique.

Certain circuits, such as for example the first and second calculation circuits 304 and 305, may be replaced with look-up tables. It should be noted that, depending on the technology used, the look-up tables may be of greater or lesser advantage, in terms of circuit size, for producing said circuits.

Another embodiment consists in using a single look-up table organized into 23-bit words and having 16 address lines for receiving the gray levels GL1 and GL2 directly. At the present time, the problem with this embodiment is the high cost of memories of this size which have to operate at a speed high enough to be able to work in real time.

In the preferred example, look-up tables are also used to carry out the coding and decoding operations for reasons of processing simplicity and therefore of reliability. It goes without saying that these look-up tables may be replaced with calculation circuits, especially if it is chosen to implement such a device by means of microcontroller-type circuits.

More generally, a person skilled in the art may also be content to carry out the method of the invention solely with the aid of programmed circuits essentially comprising a processor and a memory. The device thus produced will have a completely different structure from the device shown.

In the present description of the invention, reference is also made to codings using seven first subscans and nine second subscans. These codings were chosen for the present description as they allow good results to be obtained. Other types of codings were not referred to during the description for the sake of clarity, but it is obvious that other types of coding may be used with similar methods, independently of the number of first and second subscans and of the illumination weights associated with said subscans.

What is claimed is:

1. A method of displaying a video image on a plasma display panel comprising a plurality of discharge cells, in which each cell is illuminated for an illumination time by means of a plurality of subscans each having a specific duration, the plurality of subscans being divided into two successive time groups, and in which the illumination time for each cell is divided between the two groups, wherein each group comprises first and second subscans, the first subscans being specific to each cell and the second subscans being common to at least two cells, the sum of the durations of all of the first subscans of the first group being greater than the sum of the durations of all of the first subscans of the second group and the sum of the durations of all of the second subscans of the first group being less than the sum of the durations of all of the second subscans of the second group.

2. The method as claimed in claim 1, wherein, for each cell, the difference in illumination time between the first and second groups is compensated for between the first and second subscans so that the overall difference between the illumination times for the first and second groups is below a threshold.

3. The method as claimed in claim 2, wherein the threshold is below an illumination weight equal to 10.

4. The method as claimed in claim 1, wherein the first subscans of the first group have the weights 5, 10, 20 and 40, in that the second subscans of the first group have the weights 7, 14 and 30, in that the first subscans of the second group have the weights 10, 20 and 40 and in that the second subscans of the second group have the weights 1, 2, 4, 8, 16 and 28.

5. The method as claimed in claim 1, wherein the first subscans of the first group have the weights 5, 10, 20 and 40, in that the second subscans of the first group have the weight 8, 16 and 24, in that the first subscans of the second group have the weights 10, 20 and 40 and in that the second subscans of the second group have the weights 1, 2, 4, 8, 16 and 24.

6. Plasma display panel comprising illumination cells, wherein the cells are illuminated according to the method of claim 1.

* * * * *